US008342157B2

(12) United States Patent
Der Manuelian et al.

(10) Patent No.: US 8,342,157 B2
(45) Date of Patent: Jan. 1, 2013

(54) CHECKING FUNCTIONALITY OF FUEL TANK VAPOR PRESSURE SENSOR

(75) Inventors: Raffi Der Manuelian, Rochester Hills, MI (US); Kenneth J. Kalvelage, Rochester Hills, MI (US); Timothy E. McCarthy, Grand Blanc, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 415 days.

(21) Appl. No.: 12/707,728

(22) Filed: Feb. 18, 2010

(65) Prior Publication Data

US 2011/0197862 A1 Aug. 18, 2011

(51) Int. Cl.
*F02M 33/02* (2006.01)

(52) U.S. Cl. ..... 123/521; 123/495

(58) Field of Classification Search ..... 123/495, 123/506, 514, 516, 518–521, 527, 533; 701/103
See application file for complete search history.

(56) References Cited

U.S. PATENT DOCUMENTS

| | | | | |
|---|---|---|---|---|
| 6,732,718 | B2 * | 5/2004 | Kano et al. | 123/518 |
| 6,868,808 | B2 * | 3/2005 | Brunemann et al. | 123/3 |
| 7,363,803 | B2 * | 4/2008 | Hayakawa et al. | 123/499 |
| 2005/0022588 | A1 * | 2/2005 | Hayakawa et al. | 73/118.1 |
| 2006/0191330 | A1 * | 8/2006 | Hayakawa et al. | 73/118.1 |
| 2009/0266147 | A1 * | 10/2009 | Maegawa | 73/40.7 |

* cited by examiner

*Primary Examiner* — John T. Kwon
*Assistant Examiner* — Johnny Hoang

(57) ABSTRACT

A vehicle fuel emissions system includes a fuel tank, a tank pressure sensor indicating a pressure differential between the tank and a port communicating with the atmosphere, a pump for selectively producing vacuum in the tank, and a passage connecting the pump and a pressure sensor air reference port external to the system.

14 Claims, 1 Drawing Sheet

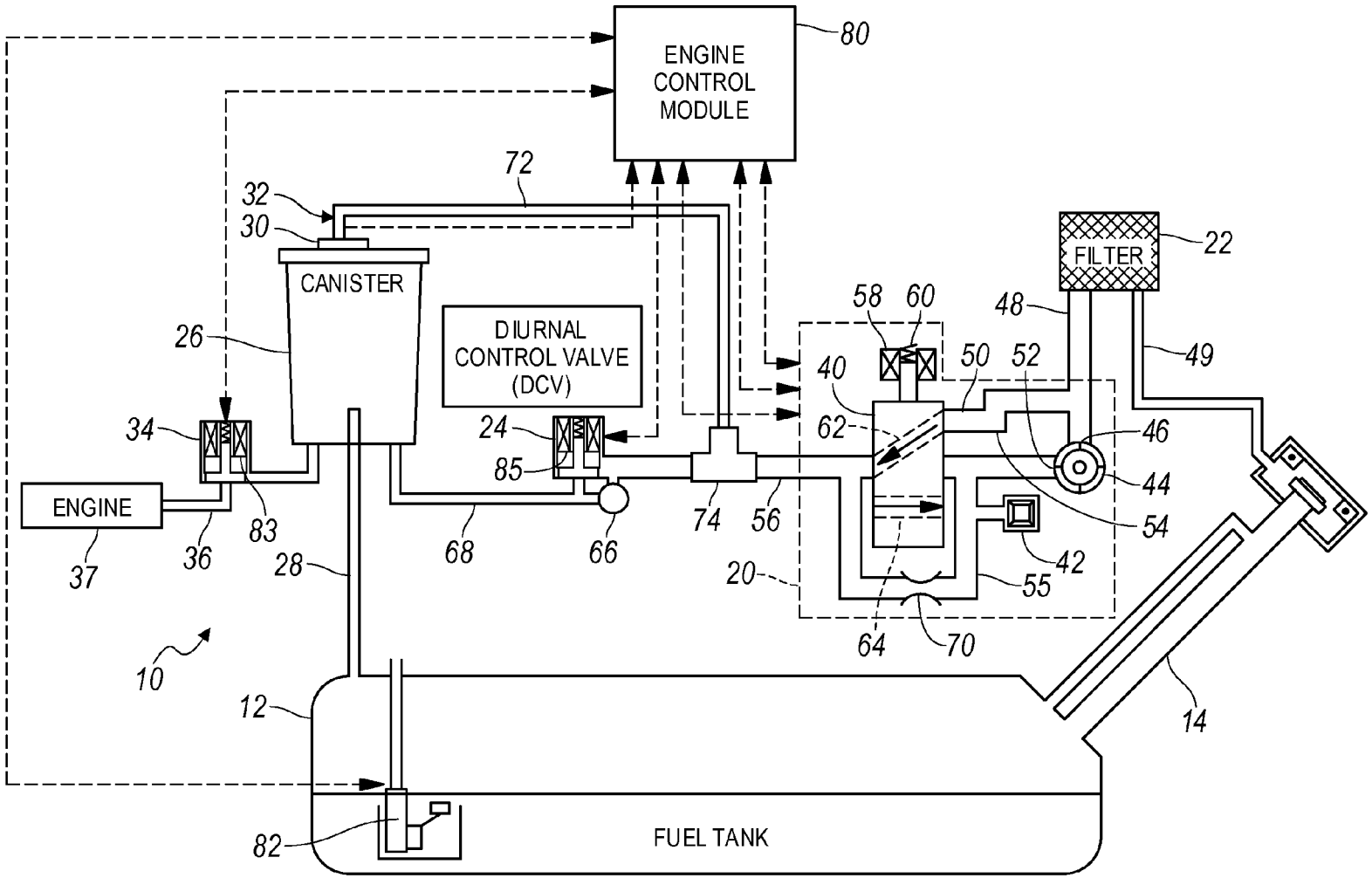
FILTER
ENGINE CONTROL MODULE
DIURNAL CONTROL VALVE (DCV)
CANISTER
ENGINE
FUEL TANK
22
49
48
46
44
54
42
52
55
50
70
60
58
40
62
64
80
56
20
74
66
72
24
85
68
32
30
26
83
28
12
82
36
34
37
10
14

CHECKING FUNCTIONALITY OF FUEL TANK VAPOR PRESSURE SENSOR

BACKGROUND OF INVENTION

The present invention relates generally to an apparatus for checking the functionality of a fuel tank vapor pressure sensor using vacuum produced by a pump at an atmospheric port.

A non-integrated vehicle fuel system includes a normally-sealed fuel tank. Fuel system integrity is verified by the presence of pressure or vacuum created by temperature difference or a leak check pump. If the system holds pressure or vacuum above a certain threshold, the fuel system is considered leak free.

Because the fuel system integrity determination relies upon the tank vapor pressure sensor reading, a rationality check must be performed on the fuel tank vapor pressure sensor. Primary failure modes such as sensor-offset or sensor-stuck-in-range must be checked.

The architecture of a non-integrated fuel system presents unique challenges to verify leak integrity without redundant pressure sensors or excessive emissions. For example, in order to reliably ensure that the indicated fuel tank vapor pressure is correct, the fuel system might, for example, include two pressure sensors and compare the outputs of the sensors. If a difference in output from the sensors is present, the system's diagnostics sets a malfunction indicator warning light. But this technique requires a second sensor, a manifold, and a hose connecting the manifold to a carbon canister.

A need exists for a fuel system and method for checking that the vapor pressure sensor returns to zero and is not stuck-in-range without actually relieving all the pressure or vacuum in the fuel tank. Performance of the system should comply with emission regulations at low cost.

SUMMARY OF INVENTION

A vehicle fuel emissions system includes a fuel tank, a tank pressure sensor indicating a pressure differential between the tank and the port in communication with the atmosphere, a pump for selectively producing vacuum in the tank, and a passage connecting the pump and the pressure sensor external air reference port to the system.

The invention contemplates a method for checking operation of a fuel tank pressure sensor in a sealed fuel system. That method includes using a tank pressure sensor to indicate a magnitude of pressure in the tank, using a pump to produce vacuum in the system, communicating said vacuum to a port communicating with the fuel tank, and checking correct operation of the fuel tank pressure sensor by comparing a pressure change indicated by the tank pressure sensor due to said vacuum with a pressure change due to said vacuum indicated by a second pressure sensor located in the system.

Under normal running conditions, the air reference port hose does not affect the output of fuel tank vapor pressure sensor because the air reference port is open to atmosphere. The system provides a reliable check on the operation of the fuel tank pressure sensor without opening the Diurnal Control Valve (DCV) and without need for a second fuel tank vapor pressure sensor.

The system lowers overall emissions and reduces cost associated with the eliminated second fuel tank vapor pressure sensor, manifold, and a hose connecting the manifold to the carbon canister. The system avoids failure modes that would prevent the second sensor from operating correctly while working concurrently with correct operation of the first sensor.

BRIEF DESCRIPTION OF DRAWINGS

The invention will be more readily understood by reference to the following description, taken with the accompanying drawing, in which the FIGURE is a schematic diagram showing a fuel system for a motor vehicle.

DETAILED DESCRIPTION

The fuel tank emission system 10 shown in the drawing, includes a fuel tank 12; a file pipe 14 through which fuel enters the tank 12; an evaporative leak check module (ELCM) 20; filter 22; a normally-closed diurnal control valve (DCV) 24; carbon canister 26, connected by a passage 28 to tank 12; fuel tank vapor pressure sensor (FTVPS) 30; an atmosphere reference port 32; and a purge valve 34, connected by a passage 36 to an engine 37. The FTVPS 30 is used to check the fuel system vapor space for the presence of a leak equivalent to about a 0.020 inch (0.508 millimeters) diameter hole.

Fuel vapor generated in tank 12 is at least partially vented through a first vapor flow path, which includes passage 28 and canister 26. Activated carbon, similar to charcoal, contained in canister 26 collects and stores the hydrocarbons. When the engine is running, air is drawn through canister 26, and the hydrocarbons are drawn into the engine 37.

The tank vapor pressure sensor 30 is essentially a membrane exposed on one side of its thickness to fuel tank and canister pressure, and on the opposite side to atmospheric pressure through port 32.

The ELCM 20 includes a valve 40, pressure sensor 42, and pump 44, preferably a vane pump. Pump 44 communicates though a port 46 with the fuel tank 12 through a second vapor flow path, which includes passages 48, 49 and a filter 22. Passages 48, 50 connect filter 22 to valve 40. The air line 56 may include the evaporative leak check module (ELCM) 20. The ELCM filter 22 filters the air flow to the ELCM 20.

The evaporative leak check module 20 includes the ELCM diverter valve 40, vacuum pump 44 and ELCM pressure sensor 42. A reference orifice 70 may also be included within the evaporative leak check module 20.

The diverter valve 40 includes a first path 62 and a second path 64, which pass through valve 40. In a first position as illustrated in the FIGURE, air is directed through path 62 of the diverter valve 40 directly from its input to the DCV 24. In the second position, the diverter valve 40 is controlled upward so that the vacuum pump 44 is in use, thereby creating vacuum in the passage 55, 56, 64 up to the diurnal control valve 24. In either case, the pressure sensor 42 generates a pressure signal corresponding to the pressure within the ELCM 20.

The pump's port 52 communicates with valve 40 through passage 64 and with pressure sensor 42, passage 56 and the DCV 24 through passage 55. Pressure sensor 42 preferably indicates absolute pressure in the system.

The valve 40 of the ELCM 20 is a two-position valve, actuated by a solenoid 58 and compression spring 60. Valve 40 moves alternately to and from the position shown in the FIGURE wherein passages 50, 56 are interconnected through valve passage 62. In the position shown in the FIGURE, the vacuum pump 44 is isolated from the system. In the alternate position, passage 50 is isolated and vacuum pump 44 can apply a pressure differential to create vacuum in passages 55, 56 and 64.

Through the use of diverter valve 40, pump 44 has ability to draw a reference vacuum on orifice 70 corresponding in magnitude to the vacuum in a fuel system having a leak through an orifice of about 0.20 inch diameter. If pump 44 can produce a larger vacuum on the complete fuel system 10 than the reference vacuum, the system 10 is assumed to be sealed. If the pump cannot produce vacuum as great as the reference vacuum, the system is assumed to be unsealed or leaking.

A pressure relief valve 66, located in a passage 68, is connected to the DCV 24 and passage 56. The reference orifice 70 is located between pressure sensor 42 and passage 56.

A low-cost snorkel hose 72 has an open end connected to the atmospheric reference port 32 of the FTVPS 30. Hose 72 is connected through a tee fitting 74 in passage 56 between the DCV 24 and pump 44.

An engine control module (ECM) 80 communicates through electronic data lines to a fuel level sensor 82 in the fuel tank 12, the solenoid 83 of purge valve 34, the FTVPS 30, the solenoid 58 and pressure sensor 42 of the ELCM 20, and the solenoid 85 of the DCV 24.

Unlike typical evaporative emissions systems that are vented to atmosphere during normal operation, the evaporative emissions system 10 is closed to atmosphere by the DCV 24. The FTVPS 30 is located on the sealed side of the DCV 24, but it is undesirable to open the DCV 24 when the gasoline engine 37 is not operating. Opening the DCV 24 without the engine running would allow the escape of hydrocarbon vapors.

In the sealed system 10, pressure in the fuel system will vary from negative to positive during normal operation and while the vehicle is parked with the engine off. No operating condition exists in which pressure in the system is predictably zero. Because of this, the fuel tank vapor pressure sensor 30 could be stuck-in-range at a pressure reading, in which case it would be impossible to diagnose the condition. A reliable way is needed to confirm that the fuel tank vapor pressure sensor 30 is operating correctly and reading the actual pressure in the fuel tank 12.

To reliably ensure that fuel tank vapor pressure sensor 30 is operating correctly, while the engine is not running, pump 44 in the ELCM 20 is used to produce vacuum, which is communicated to the atmospheric reference port 32 of the fuel tank vapor pressure sensor 30 through hose 72.

The fuel tank vapor pressure sensor 30 is intended to read the pressure differential between the sealed system 10 and atmosphere. In the illustrated example, the vapor pressure sensor 30 is attached directly to the carbon canister 26. The snorkel hose 72 connects the atmospheric reference port 32 on the fuel tank vapor pressure sensor to passage 56 between the DCV 24 and the ELCM 20 with the use of tee fitting 74. Pump 44 in the ELCM 20 creates a vacuum which is applied to the atmospheric reference port 32 on fuel tank vapor pressure sensor 30 through hose 72.

Pump 44 can produce up to 4 kPa of pressure differential between the sealed system 10 and atmosphere, which is great enough to cause a change in output of fuel tank vapor pressure sensor 30. The change in output of fuel tank vapor pressure sensor 30 can be used to confirm that the sensor is operating properly. The pressure sensor 42 in the ELCM 20 produces a signal representing absolute pressure, which is used in a rationality test to confirm that the output of fuel tank vapor pressure sensor 30 changed the correct amount when vacuum is produced in the system by pump 44.

Under normal running conditions, the air reference port hose 72 does not affect the output of fuel tank vapor pressure sensor 30 because the air reference port 32 is open to atmosphere. The air reference port 32 is protected from water splash. The system provides a reliable check on the operation of the fuel tank pressure sensor 30 without opening the DCV 24.

While certain embodiments of the present invention have been described in detail, those familiar with the art to which this invention relates will recognize various alternative designs and embodiments for practicing the invention as defined by the following claims.

What is claimed is:

1. A vehicle fuel emissions system, comprising:

a fuel tank;

a pressure sensor communicating through a port with atmosphere and indicating a pressure differential relative to atmospheric pressure;

a pump communicating with the fuel tank, for producing a vacuum while a test of the pressure sensor is performed;

a passage connecting the pump and the pressure sensor;

a second pressure sensor indicating a magnitude of vacuum produced by the pump in the passage during the test; and a controller configured to determine whether the pressure differential across the pressure sensor changed correctly relatively to a magnitude of vacuum produced by the pump in the passage during the test.

2. The system of claim 1, further comprising:

a canister communicating with the tank, wherein the pressure sensor and the port communicate with the tank through the canister.

3. The system of claim 1, further comprising a diurnal control valve for opening and closing communication between the system and atmospheric pressure external to the system.

4. The system of claim 1, further comprising:

a canister communicating with the tank; and a diurnal control valve connected to the pump and the canister, wherein the passage bypasses the diurnal control valve.

5. The system of claim 1, wherein:

the second pressure sensor indicates a magnitude of vacuum produced by the pump between the port and the pump.

6. A vehicle fuel emissions system, comprising:

a fuel tank;

a pressure sensor communicating with atmosphere indicating a pressure differential relative to atmospheric pressure;

a first vapor flow path connecting the tank and the pressure sensor;

a pump closed from communication with the fuel tank while a test of the pressure sensor is performed;

a second vapor flow path that disconnects the tank and the pump during the test;

a second pressure sensor indicating a magnitude of vacuum produced by the pump in the first vapor flow path during the test; and a controller configured to determine whether the pressure differential across the pressure sensor changed correctly relatively to a magnitude of vacuum produced by the pump during the test.

7. The system of claim 6, further comprising:

a canister located in the first vapor flow path and communicating with the tank, the pressure sensor communicating with the tank and the canister through the first vapor flow path.

8. The system of claim 6, further comprising a diurnal control valve for opening and closing communication between the system and atmospheric pressure external to the system.

9. The system of claim 6, further comprising:

a canister located in the first vapor flow path and communicating with the tank; and a diurnal control valve connected to the pump and the canister, wherein the first vapor flow path bypasses a diurnal control valve.

10. The system of claim 6, further comprising:

a second pressure sensor indicating a magnitude of vacuum produced by the pump between the port and the pump; and a diverter valve for opening a first path between the fuel tank and the pressure sensor, and for closing said first path and opening a second path from the pressure sensor to a suction port of the pump and the second pressure sensor during the test.

11. The system of claim 10 wherein the second pressure sensor indicates absolute pressure.

12. A method for checking operation of a sealed fuel emissions system for a vehicle, comprising the steps of:

(a) using a pressure sensor connected to atmosphere to indicate a pressure differential across the pressure sensor relative to atmospheric pressure;

(b) using a pump to produce vacuum in the system;

(c) communicating said vacuum to a second pressure sensor; and (d) checking correct operation of the pressure sensor by comparing a pressure change indicated by the pressure sensor due to said vacuum with a pressure change due to said vacuum indicated by the second pressure sensor.

13. The method of claim 12 further comprising sealing the system by maintaining closed a diurnal control valve that opens communication between the pump and the fuel tank when the diurnal control valve is open.

14. The method of claim 12, further comprising operating a diverter valve that opens a first path between a fuel tank and the pressure sensor, and closes said first path and opens a second path during the test from the pressure sensor to a suction port of the pump and the second pressure sensor.

* * * * *